US007361003B2

(12) United States Patent
Hwang et al.

(10) Patent No.: US 7,361,003 B2
(45) Date of Patent: Apr. 22, 2008

(54) SLIDER ADAPTING APPARATUS FOR ORBITING VANE COMPRESSORS

(75) Inventors: Seon-woong Hwang, Anyang-si (KR); Dong-won Yoo, Seoul (KR)

(73) Assignee: LG Electronics Inc., Seoul (KR)

( * ) Notice: Subject to any disclaimer, the term of this patent is extended or adjusted under 35 U.S.C. 154(b) by 83 days.

(21) Appl. No.: 11/208,716

(22) Filed: Aug. 23, 2005

(65) Prior Publication Data

US 2006/0127258 A1 Jun. 15, 2006

(30) Foreign Application Priority Data

Dec. 14, 2004 (KR) ..... 10-2004-0105641

(51) Int. Cl.

| | |
|---|---|
| ***F01C 1/02*** | (2006.01) |
| ***F01C 1/063*** | (2006.01) |
| ***F03C 2/00*** | (2006.01) |
| ***F03C 4/00*** | (2006.01) |

(52) U.S. Cl. ..... 418/54; 418/59; 418/64; 418/65

(58) Field of Classification Search ..... 418/55.1–55.6, 418/58, 59, 241; 417/212, 213, 279
See application file for complete search history.

(56) References Cited

U.S. PATENT DOCUMENTS 5,284,426 A * 2/1994 Strikis et al. ..... 418/6
5,302,095 A * 4/1994 Richardson, Jr. ..... 418/57
5,383,773 A * 1/1995 Richardson, Jr. ..... 418/57
5,472,327 A * 12/1995 Strikis et al. ..... 418/15
2006/0127256 A1* 6/2006 Hwang et al. ..... 418/29

FOREIGN PATENT DOCUMENTS

KR 2004007984 A * 1/2004
KR 1020040007984 A * 1/2004

OTHER PUBLICATIONS

U.S. Appl. No. 11/111,881 to Hwang et al., which was filed Apr. 22, 2005.
U.S. Appl. No. 11/208,718 to Hwang et al., which was filed Aug. 23, 2005.

* cited by examiner

*Primary Examiner*—Thomas Denion
*Assistant Examiner*—Douglas J. Duff
(74) *Attorney, Agent, or Firm*—Greenblum & Berstein, P.L.C.

(57) ABSTRACT

Disclosed herein is a slider adapting apparatus for orbiting vane compressors. A circular vane of an orbiting vane is disposed in an annular space defined in a cylinder. A pair of sliders is coupled with the circular vane for performing reciprocating movement along the annular space while being in tight contact with both ends of an opening formed at the circular vane to seal between compression chambers formed in the annular space. The slider adapting apparatus comprises a gap defined between the sliders, which are spaced apart from each other, and a gap maintaining part for maintaining the gap while increasing and decreasing the gap. Using the slider adapting apparatus, damage to parts and a locking phenomenon due to severe interference between the circular vane and the sliders are prevented, and therefore, a drive unit of the orbiting vane compressor is effectively prevented from suffering overload and catching fire.

6 Claims, 11 Drawing Sheets

SLIDER ADAPTING APPARATUS FOR ORBITING VANE COMPRESSORS

BACKGROUND OF THE INVENTION

1. Field of the Invention

The present invention relates to an orbiting vane compressor, and, more particularly, to a slider adapting apparatus for orbiting vane compressors that is capable of adapting sliders to a circular vane to increase shock-absorption and a sealing force while preventing interference from occurring between an opening formed at the circular vane and outside surfaces of the sliders.

2. Description of the Related Art

Referring to FIG. 1, there is illustrated a conventional orbiting vane compressor. As shown in FIG. 1, a drive unit D and a compression unit P are mounted in a shell 1 while the drive unit D and the compression unit P are hermetically sealed. The drive unit D and the compression unit P are connected to each other via a vertical crankshaft 8, the upper and lower ends of which are rotatably supported by a main frame 6 and a subsidiary frame 7, respectively, such that power from the drive unit D is transmitted to the compression unit P through the crankshaft 8.

The drive unit D comprises: a stator 2 fixedly disposed between the main frame 6 and the subsidiary frame 7; and a rotor 3 disposed in the stator 2 for rotating the crankshaft 8, which vertically extends through the rotor 3, when electric current is supplied to the rotor 3. The rotor 3 is provided at the top and bottom parts thereof with balance weights 3*a*, which are disposed symmetrically to each other for preventing the crankshaft 8 from being rotated in an unbalanced state due to a crank pin 81.

The compression unit P comprises an orbiting vane 5 having a boss 55 formed at the upper part thereof. The crank pin 81 is fixedly fitted in the boss 55 of the orbiting vane 5. As the orbiting vane 5 performs an orbiting movement in a cylinder 4, refrigerant gas introduced into the cylinder 4 is compressed. The cylinder 4 comprises an inner ring 41 integrally formed at the upper part thereof while being protruded downward. The orbiting vane 5 comprises a circular vane 51 formed at the upper part thereof while being protruded upward. The circular vane 51 performs an orbiting movement in an annular space 42 defined between the inner ring 41 and the inner wall of the cylinder 4. Through the orbiting movement of the circular vane 51, inner and outer compression chambers are formed at the inside and the outside of the circular vane 51, respectively. Refrigerant gases compressed in the inner and outer compression chambers are discharged out of the cylinder 4 through inner and outer outlet ports 44 and 44*a* formed at the upper part of the cylinder 4, respectively.

Between the main frame 6 and the orbiting vane 5 is disposed an Oldham's ring 9 for preventing rotation of the orbiting vane 5. Through the crankshaft 8 is longitudinally formed an oil supplying channel 82 for allowing oil to be supplied to the compression unit P therethrough when an oil pump 83 mounted at the lower end of the crankshaft 8 is operated.

Unexplained reference numeral 1*a* indicates an inlet tube, 1*b* a high-pressure chamber, and 1*c* an outlet tube.

FIG. 2 is an exploded perspective view illustrating main components of the conventional orbiting vane compressor shown in FIG. 1. In the compression unit P, as shown in FIG. 2, the orbiting vane 5, which is connected to the crankshaft 8, is disposed on the upper end of the main frame 6, which rotatably supports the upper part of the crankshaft 8. The cylinder 4, which is attached to the main frame 6, is disposed above the orbiting vane 5. The cylinder 4 is provided at a predetermined position of the circumferential part thereof with an inlet port 43. The inner and outer outlet ports 44 and 44*a* are formed at predetermined positions of the upper end of the cylinder 4.

The crank pin 81 of the crankshaft 8 is fixedly fitted in the boss 55, which is formed at the upper part of a vane plate 50 of the orbiting vane 5. At a predetermined position of the circumferential part of the circular vane 51 of the orbiting vane 5 is formed a through-hole 52 for allowing refrigerant gas introduced through the inlet port 43 of the cylinder 4 to be guided into the circular vane 51 therethrough. At another predetermined position of the circumferential part of the circular vane 51 of the orbiting vane 5, which is adjacent to the position where the through-hole 52 is disposed, is formed an opening 53. A slider 54, which serves as a sealing member, is slidably disposed in the opening 53 to accomplish sealing between the inner and outer compression chambers.

FIG. 3 is a plan view, in section, illustrating the operation of the conventional orbiting vane compressor.

When the orbiting vane 5 of the compression unit P is driven by power transmitted to the compression unit P from the drive unit D through the crankshaft 8 (See FIG. 1), the circular vane 51 of the orbiting vane 5 disposed in the annular space 42 of the cylinder 4 performs an orbiting movement in the annular space 42 of the cylinder 4, as indicated by arrows, to compress refrigerant gas introduced into the annular space 42 through the inlet port 43.

At the initial orbiting position of the orbiting vane 5 of the compression unit P (i.e., the 0-degree orbiting position), refrigerant gas is introduced into an inner suction chamber A1 through the inlet port 43 and the through-hole 52 of the circular vane 51, and compression is performed in an outer compression chamber B2 of the circular vane 51 while the outer compression chamber B2 does not communicate with the inlet port 43 and the outer outlet port 44*a*. Refrigerant gas is compressed in an inner compression chamber A2, and at the same time, the compressed refrigerant gas is discharged out of the inner compression chamber A2 through the inner outlet port 44.

At the 90-degree orbiting position of the orbiting vane 5 of the compression unit P, the compression is still performed in the outer compression chamber B2 of the circular vane 51, and almost all the compressed refrigerant gas is discharged out of the inner compression chamber A2 of the circular vane 51 through the inner outlet port 44. At this stage, an outer suction chamber B1 appears so that refrigerant gas is introduced into the outer suction chamber B1 through the inlet port 43.

At the 180-degree orbiting position of the orbiting vane 5 of the compression unit P, the inner suction chamber A1 disappears. Specifically, the inner suction chamber A1 is changed into the inner compression chamber A2, and therefore, compression is performed in the inner compression chamber A2. At this stage, the outer compression chamber B2 communicates with the outer outlet port 44*a*. Consequently, compressed refrigerant gas is discharged out of the outer compression chamber B2 through the outer outlet port 44*a*.

At the 270-degree orbiting position of the orbiting vane 5 of the compression unit P, almost all the compressed refrigerant gas is discharged out of the outer compression chamber B2 of the circular vane 51 through the outer outlet port 44*a*, and the compression is still performed in the inner compression chamber A2 of the circular vane 51. Also, compression is newly performed in the outer suction chamber B1. When the orbiting vane 5 of the compression unit P further performs the orbiting movement by 90 degrees, the outer suction chamber B1 disappears. Specifically, the outer suction chamber B1 is changed into the outer compression chamber B2, and therefore, the compression is continuously performed in the outer compression chamber B2. As a result, the orbiting vane 5 of the compression unit P is returned to the position where the orbiting movement of the orbiting vane 5 is initiated. In this way, a 360-degree-per-cycle orbiting movement of the orbiting vane 5 of the compression unit P is accomplished. The orbiting movement of the orbiting vane 5 of the compression unit P is performed in a continuous fashion.

The slider 54 is slidably disposed in the opening 53 for maintaining the seal between the inner and outer compression chambers A2 and B2 of the circular vane 51.

In the conventional orbiting vane compressor with the above-stated construction, however, the slider performs curved reciprocating movement along the annular space when the circular vane performs the orbiting movement. As a result, angles at both sides of the slider, which are in tight contact with the opening of the circular vane, are changed, and therefore, the distance between both ends of the opening is greater than the distance between both sides of the slider at certain sections. Consequently, severe interference between the opening of the circular vane and the slider occurs.

Since the severe interference between the opening of the circular vane and the slider occurs as described above, parts at the position where the interference occurs may be damaged, or the parts may be engaged with each other, and therefore, the operation of the circular vane may be stopped. In other words, a locking phenomenon may occur.

When the locking phenomenon occurs, the drive unit, which comprises the stator and the rotor, suffers overload, which generates excessive current. Consequently, the stator may be burned.

SUMMARY OF THE INVENTION

Therefore, the present invention has been made in view of the above problems, and it is an object of the present invention to provide a slider adapting apparatus for orbiting vane compressors that is capable of adapting sliders to a circular vane to increase shock-absorption and a sealing force while preventing interference from occurring between an opening formed at the circular vane and outside surfaces of the sliders.

It is another object of the present invention to provide a slider adapting apparatus for orbiting vane compressors having a pair of sliders, which are spaced apart from each other by high-pressure refrigerant gas such that the sliders can be more smoothly adapted to the circular vane.

It is another object of the present invention to provide a slider adapting apparatus for orbiting vane compressors having a resilient member disposed between the sliders such that the sliders can be adapted to the circular vane in a more simple structure, and the sliders can be properly operated before high-pressure refrigerant gas is created when the operation of the orbiting vane compressor is initiated.

It is still another object of the present invention to provide a slider adapting apparatus for orbiting vane compressors that is capable of accomplishing smooth introduction of high-pressure gas into a gap defined between the sliders while the sliders are reciprocated.

In accordance with one aspect of the present invention, the above and other objects can be accomplished by the provision of a slider adapting apparatus for orbiting vane compressors, comprising: an annular space defined between the inner wall of a cylinder and an inner ring; and an orbiting vane, wherein the orbiting vane comprises: a circular vane disposed in the annular space; a through-hole formed at the circular vane for allowing refrigerant gas to be introduced into the circular vane therethrough; an opening formed at the circular vane while being adjacent to the through-hole; and a pair of sliders disposed in the opening such that the sliders can be slid along the annular space.

Preferably, the sliders comprise: a first curved slider performing curved movement along the annular space; and a second curved slider performing curved movement along the annular space, the first curved slider and the second curved slider being formed in the shape of an arc-shaped block such that the first curved slider and the second curved slider perform curved reciprocating movement along the annular space while being in tight contact with both ends of the opening of the circular vane.

Preferably, the slider adapting apparatus further comprises: a gap defined between the first curved slider and the second curved slider, which are spaced apart from each other; and a gap maintaining part for maintaining the gap while increasing and decreasing the gap.

Preferably, the gap maintaining part comprises: a gas guide hole formed through the cylinder above the gap for allowing high-pressure refrigerant gas to be introduced into the gap therethrough. Also, the gap maintaining part comprises: a resilient member disposed in the gap while being in tight contact with the inside surface of the first curved slider and the inside surface of the second curved slider.

Preferably, the first curved slider is provided at the upper surface thereof, which corresponds to the gas guide hole, with a first curved guide groove, which is formed along a curved path of the first curved slider, and the second curved slider is provided at the upper surface thereof, which corresponds to the gas guide hole, with a second curved guide groove, which is formed along a curved path of the second curved slider.

In accordance with another aspect of the present invention, there is provided a linear slider adapting apparatus for orbiting vane compressors, comprising: an annular space defined between the inner wall of a cylinder and an inner ring; a linear space section formed in the annular space, the linear space section being defined by linear parts of the inner wall of the cylinder and the inner ring, which are parallel with each other; and an orbiting vane, wherein the orbiting vane comprises: a circular vane disposed in the annular space; a through-hole formed at the circular vane for allowing refrigerant gas to be introduced into the circular vane therethrough; an opening formed at the circular vane while being adjacent to the through-hole; and first and second linear sliders disposed in the opening such that the first and second linear sliders can slid along the linear space section.

Preferably, the first linear slider and the second linear slider are formed in the shape of a linear block such that the first linear slider and the second linear slider perform linear reciprocating movement along the linear space section.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

Figure 1:
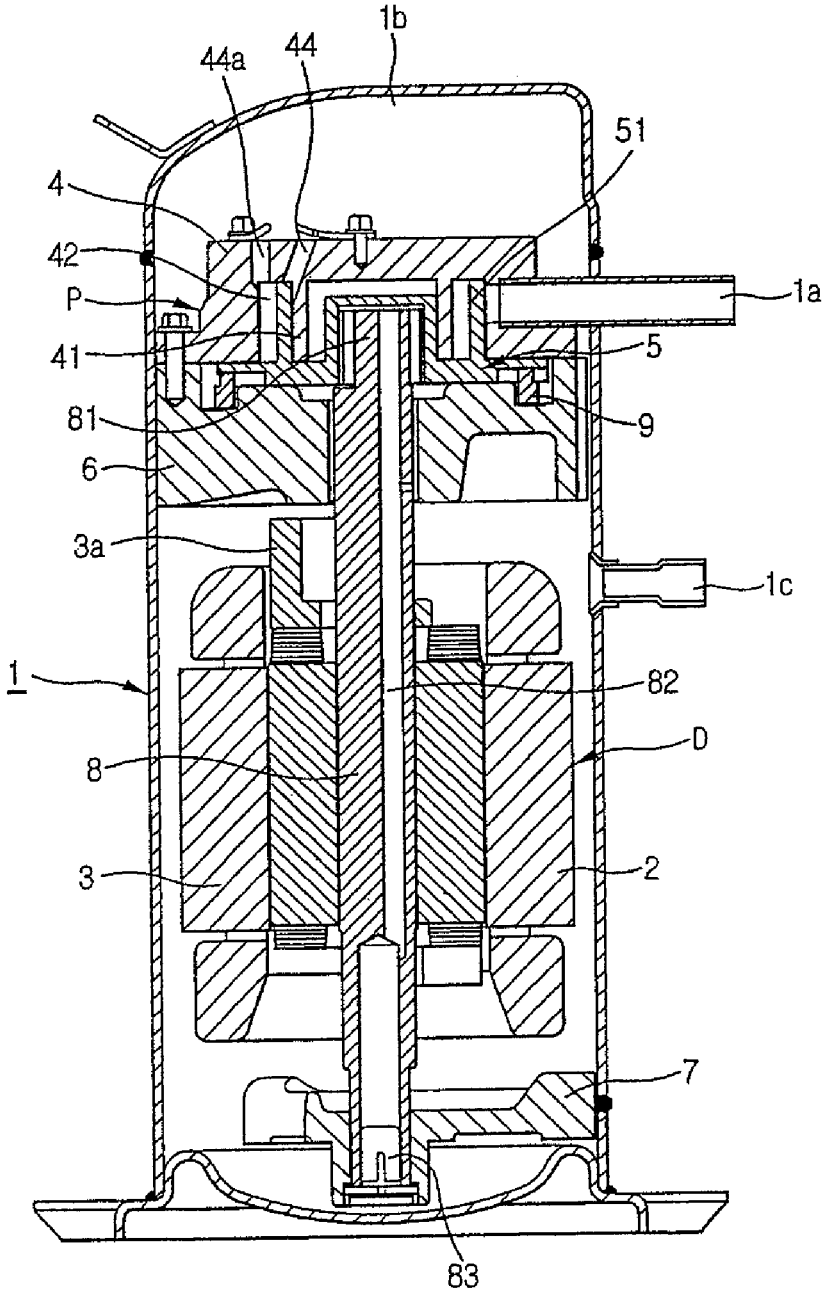
Fig.1 Related Art
FIG. 1 is a longitudinal sectional view illustrating the overall structure of a conventional orbiting vane compressor.
Figure 2:
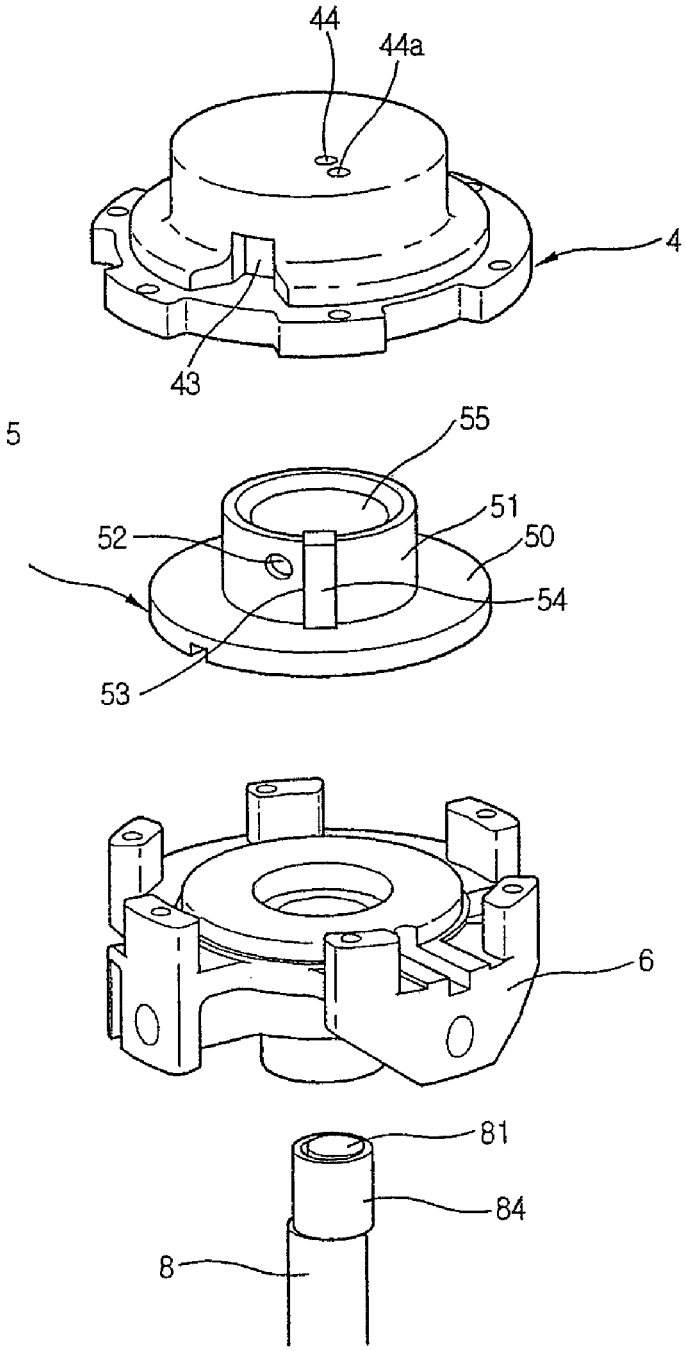
Fig.2 Related Art
FIG. 2 is an exploded perspective view illustrating main components of the conventional orbiting vane compressor shown in FIG. 1.
Figure 3:
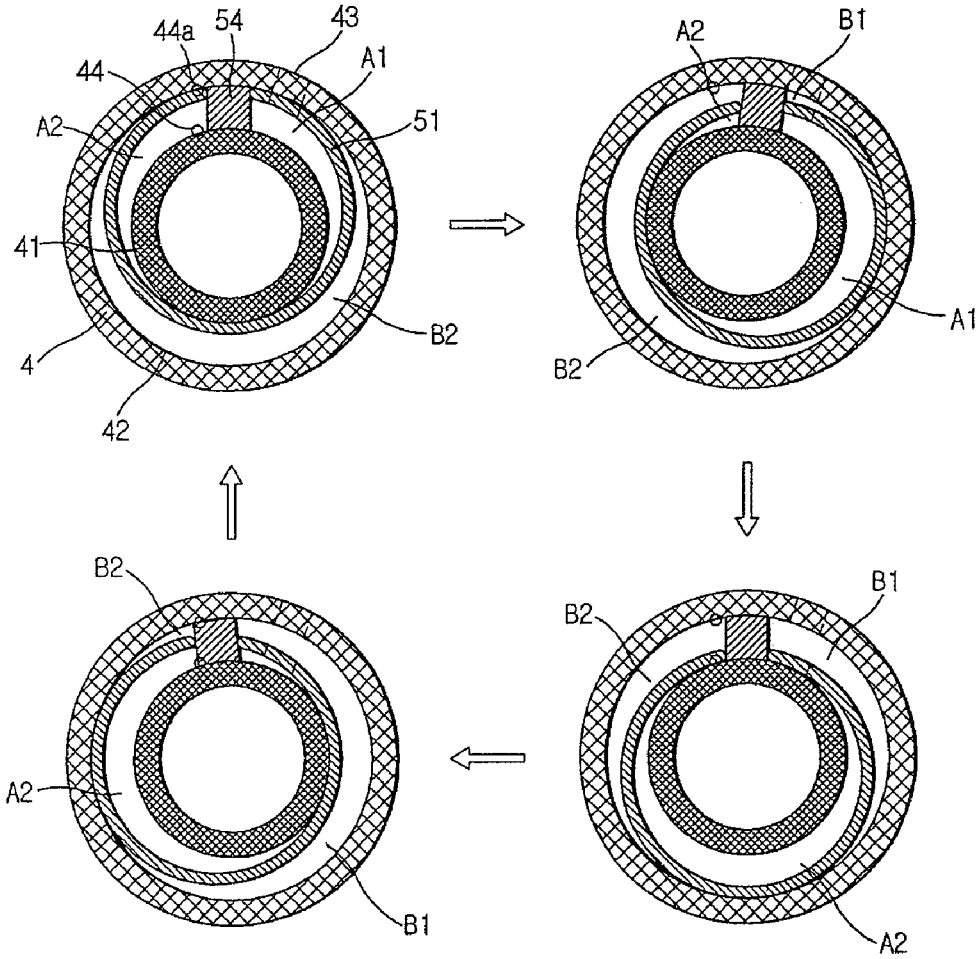
Fig.3 Related Art
FIG. 3 is a plan view, in section, illustrating the operation of the conventional orbiting vane compressor.
Figure 4:
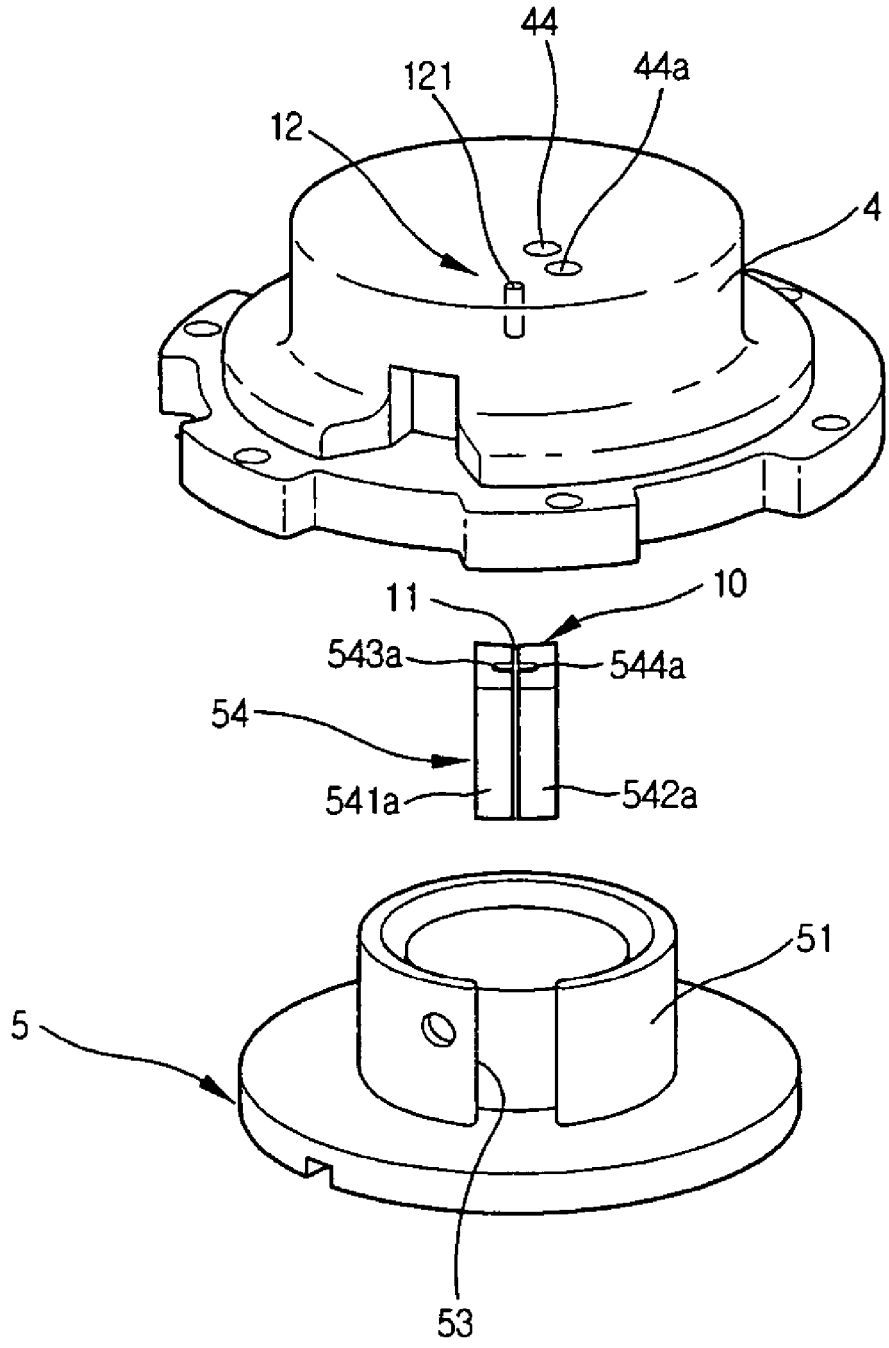
FIG. 4 is an exploded perspective view illustrating a slider adapting apparatus for orbiting vane compressors according to a first preferred embodiment of the present invention.
Figure 5:
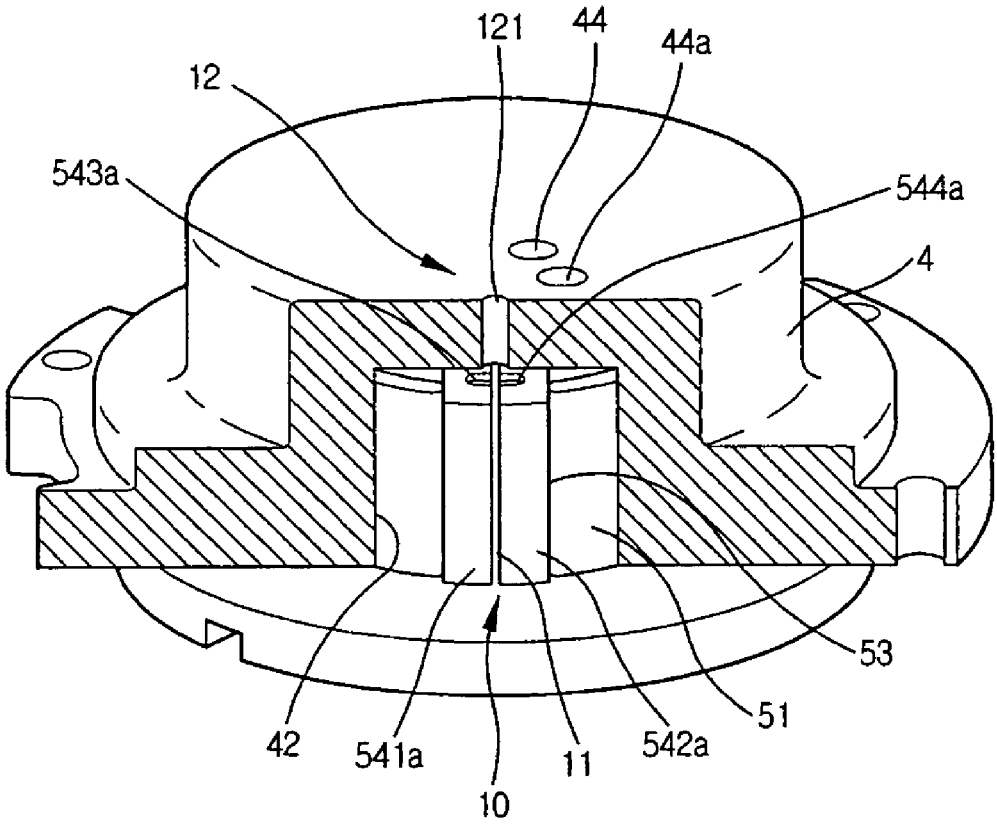
FIG. 5 is an assembled perspective view, partially cut away, illustrating the slider adapting apparatus for orbiting vane compressors according to the first preferred embodiment of the present invention shown in FIG. 4.

FIG. 4 is an exploded perspective view illustrating a slider adapting apparatus for orbiting vane compressors according to a first preferred embodiment of the present invention, and FIG. 5 is an assembled perspective view, partially cut away, illustrating the slider adapting apparatus for orbiting vane compressors according to the first preferred embodiment of the present invention shown in FIG. 4.

As shown in FIGS. 4 and 5, the slider adapting apparatus for orbiting vane compressors comprises: a sealing unit 54 disposed in tight contact with an opening 53 formed at a circular vane 51 of an orbiting vane 5; and an adapting unit 10 for adapting the sealing unit 54 to the opening 53 of the circular vane 51.

The sealing unit 54 comprises: a first curved slider 541*a* disposed in tight contact with one end of the opening 53 of the circular vane 51; and a second curved slider 542*a* disposed in tight contact with the other end of the opening 53 of the circular vane 51.

The first curved slider 541*a* and the second curved slider 542*a* are formed in the shape of an arc-shaped block such that the first curved slider 541*a* and the second curved slider 542*a* are coupled with the circular vane 51 of the orbiting vane 5, which is disposed in an annular space 42 defined in a cylinder 4, to perform curved reciprocating movement along the annular space 42 while being in tight contact with both ends of the opening 53 of the circular vane 51.

The adapting unit 10 is configured to move the first curved slider 541*a* and the second curved slider 542*a* toward both ends of the opening 53 of the circular vane 51 or to withdraw the first curved slider 541*a* and the second curved slider 542*a* from both ends of the opening 53 of the circular vane 51 such that the first curved slider 541*a* and the second curved slider 542*a* are adapted to the orbiting movement of the circular vane 51.

Consequently, the adapting unit 10 moves the first curved slider 541*a* and the second curved slider 542*a* toward both ends of the opening 53 of the circular vane 51, until the first curved slider 541*a* and the second curved slider 542*a* come into tight contact with both ends of the opening 53 of the circular vane 51, respectively, to increase a sealing force between inner and outer compression chambers. Also, the adapting unit 10 withdraws the first curved slider 541*a* and the second curved slider 542*a* from both ends of the opening 53 of the circular vane 51, when severe interference occurs between the first and second curved sliders 541*a* and 542*a* and the opening 53 of the circular vane 51, to accomplish shock-absorption.

Specifically, the adapting unit 10 comprises: a gap 11 defined between the first curved slider 541*a* and the second curved slider 542*a*, which are spaced apart from each other; and a gap maintaining part 12 for maintaining the gap 11 while increasing and decreasing the gap 11.

The first curved slider 541*a* and the second curved slider 542*a* are spaced apart from each other by the gap 11, and then the gap 11 is increased by the gap maintaining part 12 until the first curved slider 541*a* and the second curved slider 542*a* come into tight contact with both ends of the opening 53 of the circular vane 51, respectively. When severe interference between the first and second curved sliders 541*a* and 542*a* and the opening 53 of the circular vane 51 occurs, the first curved slider 541*a* and the second curved slider 542*a* are withdrawn from both ends of the opening 53 of the circular vane 51 such that the gap 11 is decreased. In this way, occurrence of severe interference between the first and second curved sliders 541*a* and 542*a* and the opening 53 of the circular vane 51 is effectively prevented.

Preferably, the gap maintaining part 12 is composed of a gas guide hole 121 formed through the cylinder 4 above the gap 11. High-pressure refrigerant gas discharged out of the cylinder 4 through the outlet ports 44 and 44*a* formed at the cylinder 4 is introduced into the gap 11 through the gas guide hole 121.

When the high-pressure refrigerant gas is introduced into the gap 11 defined between the first curved slider 541*a* and the second curved slider 542*a* through the gas guide hole 121, the first curved slider 541*a* and the second curved slider 542*a* are moved outward such that the gap 11 defined between the first curved slider 541*a* and the second curved slider 542*a* is increased. As a result, the first curved slider 541*a* and the second curved slider 542*a* come into tight contact with both ends of the opening 53 of the circular vane 51, respectively, and therefore, a sealing force between the inner and outer compression chambers is increased.

When severe interference occurs between the opening 53 of the circular vane 51 and the first and second curved sliders 541*a* and 542*a*, the first curved slider 541*a* and the second curved slider 542*a* are moved inward such that the gap 11 defined between the first curved slider 541*a* and the second curved slider 542*a* is decreased. As a result, shock-absorption is accomplished.

As described above, the first curved slider 541*a* and the second curved slider 542*a* are in tight contact with both ends of the opening 53 of the circular vane 51, under the condition that the first curved slider 541*a* and the second curved slider 542*a* can be withdrawn from both ends of the opening 53 of the circular vane 51, by means of the gap 11 and the gap maintaining part 12, such that the first curved slider 541*a* and the second curved slider 542*a* are adapted to the orbiting movement of the circular vane 51. Consequently, the tight sealing is accomplished between the inner and outer compression chambers formed in the annular space 42 of the cylinder 4, and at the same time, severe interference occurs between the opening 53 of the circular vane 51 and the first and second curved sliders 541*a* and 542*a* is effectively prevented.

The first curved slider 541*a* is provided at the upper surface thereof, which corresponds to the gas guide hole 121, with a first curved guide groove 543*a*, which is formed along the curved path of the first curved slider 541*a*. Similarly, the second curved slider 542*a* is provided at the upper surface thereof, which corresponds to the gas guide hole 121, with a second curved guide groove 544*a*, which is formed along the curved path of the second curved slider 542*a*.

The first curved guide groove 543*a* and the second curved guide groove 544*a* serve to smoothly guide high-pressure refrigerant gas discharged through the gas guide hole 121 into the gap 11 when the first curved slider 541*a* and the second curved slider 542*a* perform the curved reciprocating movement along the annular space 42 of the cylinder 4 together with the circular vane 51.

Consequently, the first curved guide groove 543*a* and the second curved guide groove 544*a* are formed in the shape of a curved line such that the first curved guide groove 543*a* and the second curved guide groove 544*a* correspond to the gas guide hole 121 while following the movement paths of the first curved slider 541*a* and the second curved slider 542*a*, i.e., the curved paths of the first curved slider 541*a* and the second curved slider 542*a* in which the first curved slider 541*a* and the second curved slider 542*a* are moved along the annular space 42 of the cylinder 4.

Figure 6:
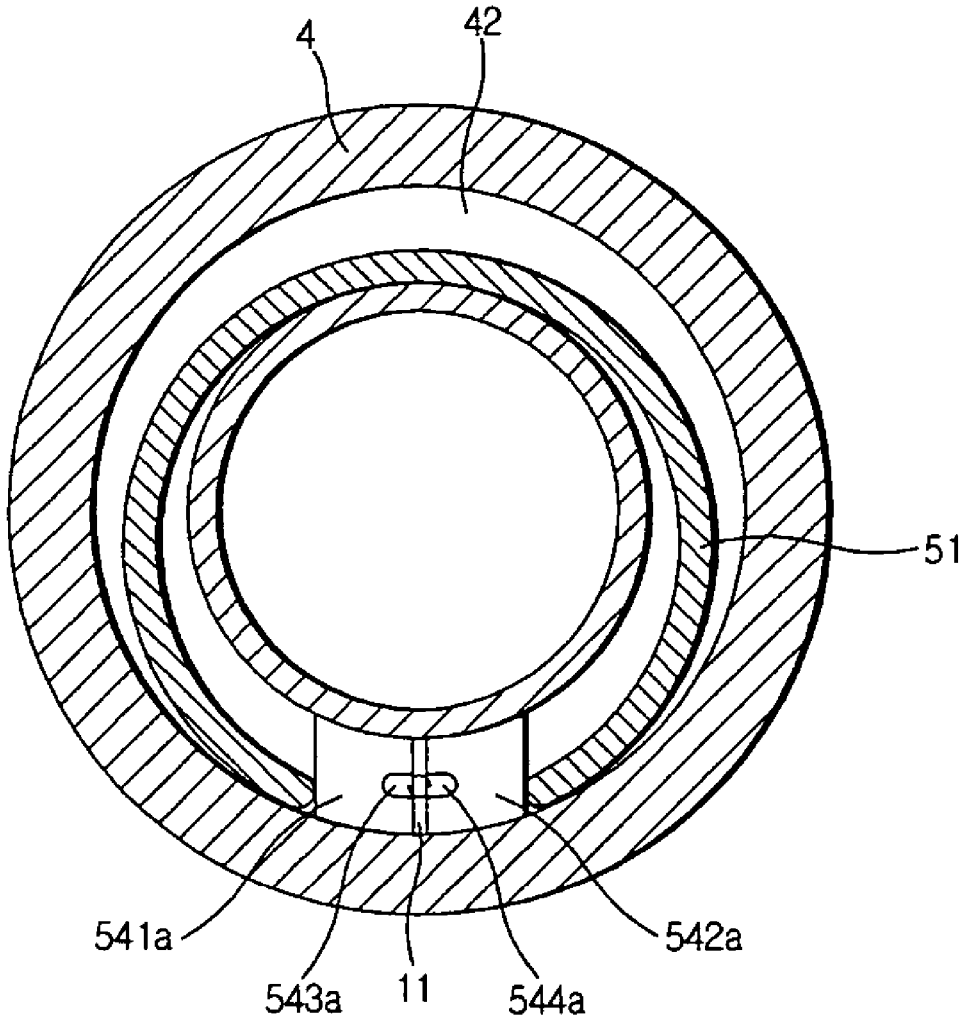
FIG. 6 is a plan view, in section, illustrating the slider adapting apparatus for orbiting vane compressors according to the first preferred embodiment of the present invention.
Figure 7:
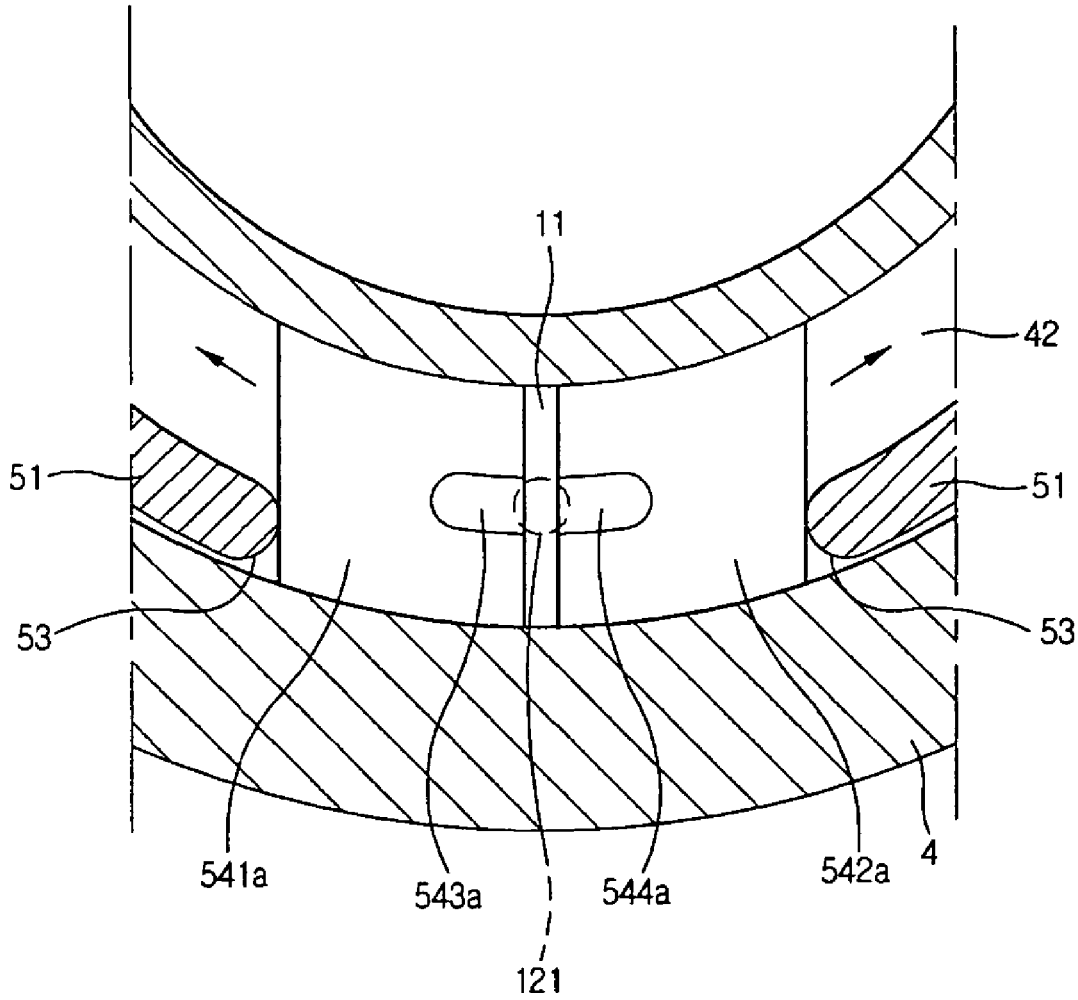
FIG. 7 is a partially enlarged view illustrating the slider adapting apparatus for orbiting vane compressors according to the first preferred embodiment of the present invention shown in FIG. 6.

FIG. 6 is a plan view, in section, illustrating the slider adapting apparatus for orbiting vane compressors according to the first preferred embodiment of the present invention, and FIG. 7 is a partially enlarged view illustrating the slider adapting apparatus for orbiting vane compressors according to the first preferred embodiment of the present invention shown in FIG. 6.

In the slider adapting apparatus for orbiting vane compressors as shown in FIGS. 6 and 7, the first curved slider 541*a* and the second curved slider 542*a* are moved outward along the annular space 42 of the cylinder, such that the gap 11 between the first curved slider 541*a* and the second curved slider 542*a* is increased, when high-pressure refrigerant gas is directly introduced into the gap 11 through the gas guide hole 121 or when the high-pressure refrigerant gas is guided by the first curved guide groove 543*a* and the second curved guide groove 544*a* and is then introduced into the gap 11.

As the gap 11 between the first curved slider 541*a* and the second curved slider 542*a* is increased by the high-pressure refrigerant gas as described above, the first curved slider 541*a* and the second curved slider 542*a* come into tight contact with both ends of the opening 53 of the circular vane 51. Consequently, a sealing force between inner and outer compression chambers are considerably increased.

When severe interference occurs between the circular vane 51 and the first and second curved sliders 541*a* and 542*a*, the first curved slider 541*a* and the second curved slider 542*a* are moved inward, i.e., the first curved slider 541*a* and the second curved slider 542*a* are withdrawn from both ends of the opening 53 of the circular vane 51 such that the gap 11 is decreased.

As the first curved slider 541*a* and the second curved slider 542*a* are withdrawn from both ends of the opening 53 of the circular vane 51, occurrence of interference between the first and second curved sliders 541*a* and 542*a* and the circular vane 51 is effectively prevented, and therefore, shock-absorption is accomplished.

After occurrence of interference between the first and second curved sliders 541*a* and 542*a* and the circular vane 51 is effectively prevented by the withdrawal of the first curved slider 541*a* and the second curved slider 542*a* from both ends of the opening 53 of the circular vane 51 as described above, the gap 11 between the first curved slider 541*a* and the second curved slider 542*a* is increased again by high-pressure refrigerant gas introduced into the gap 11, and therefore, the first curved slider 541*a* and the second curved slider 542*a* are moved outward along the annular space 42 of the cylinder 4, such that the first curved slider 541*a* and the second curved slider 542*a* come into tight contact with both ends of the opening 53 of the circular vane 5, to increase a sealing force between inner and outer compression chambers.

Figure 8:
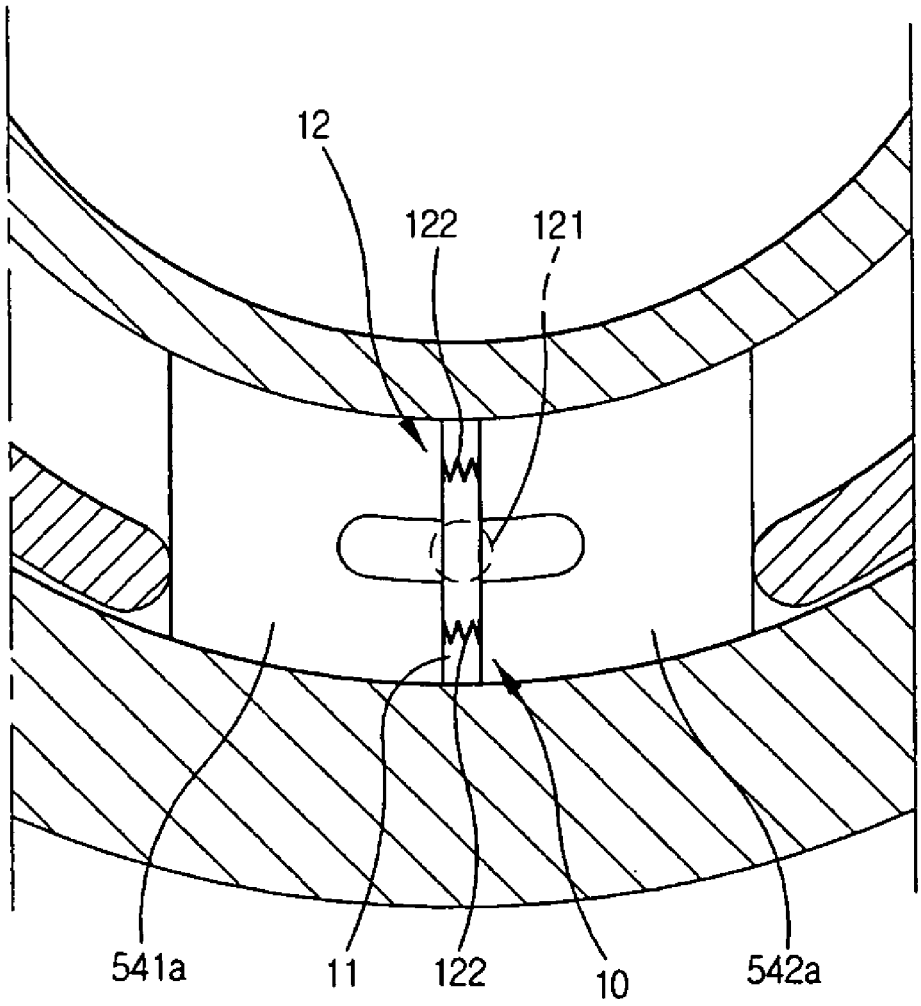
FIG. 8 is a partially enlarged plan view, in section, illustrating a slider adapting apparatus for orbiting vane compressors according to a second preferred embodiment of the present invention.

FIG. 8 is a partially enlarged plan view, in section, illustrating a slider adapting apparatus for orbiting vane compressors according to a second preferred embodiment of the present invention.

As shown in FIG. 8, the adapting unit 10 of the slider adapting apparatus comprises: a gap 11 defined between a first curved slider 541*a* and a second curved slider 542*a*, which are spaced apart from each other; and a gap maintaining part 12 for maintaining the gap 11 while increasing and decreasing the gap 11.

The gap maintaining part 12 is composed of a resilient member 122 disposed in the gap 11 while being in tight contact with the inside surface of the first curved slider 541*a* and the inside surface of the second curved slider 542*a*.

The resilient member 122 serves to push the first curved slider 541*a* and the second curved slider 542*a* outward, such that the gap 11 between the first curved slider 541*a* and the second curved slider 542*a* is increased, by its own resilient force. Consequently, the operation of the first curved slider 541*a* and the second curved slider 542*a* is smoothly performed by virtue of the resilient member 122, when the operation of the orbiting vane compressor is initiated, i.e., when high-pressure refrigerant gas is not introduced into the gap 11 through the gas guide hole 121.

Preferably, the resilient member 122 is a coil spring, having one end connected to the inside surface of the first curved slider 541*a* and the other end connected to the inside surface of the second curved slider 542*a*, for applying a resilient force to the first curved slider 541*a* and the second curved slider 542*a*. It is understood, however, that the resilient member 122 may take any other various shapes instead of the coil spring.

Moreover, it is possible to use only the resilient member 122, which is disposed in the gap 11 while being in tight contact with the inside surface of the first curved slider 541*a* and the inside surface of the second curved slider 542*a*, without the introduction of high-pressure refrigerant gas into the gap 11. It can be easily understood, in this case, that the slider adapting apparatus for orbiting vane compressors is still adequately operated.

Figure 9:
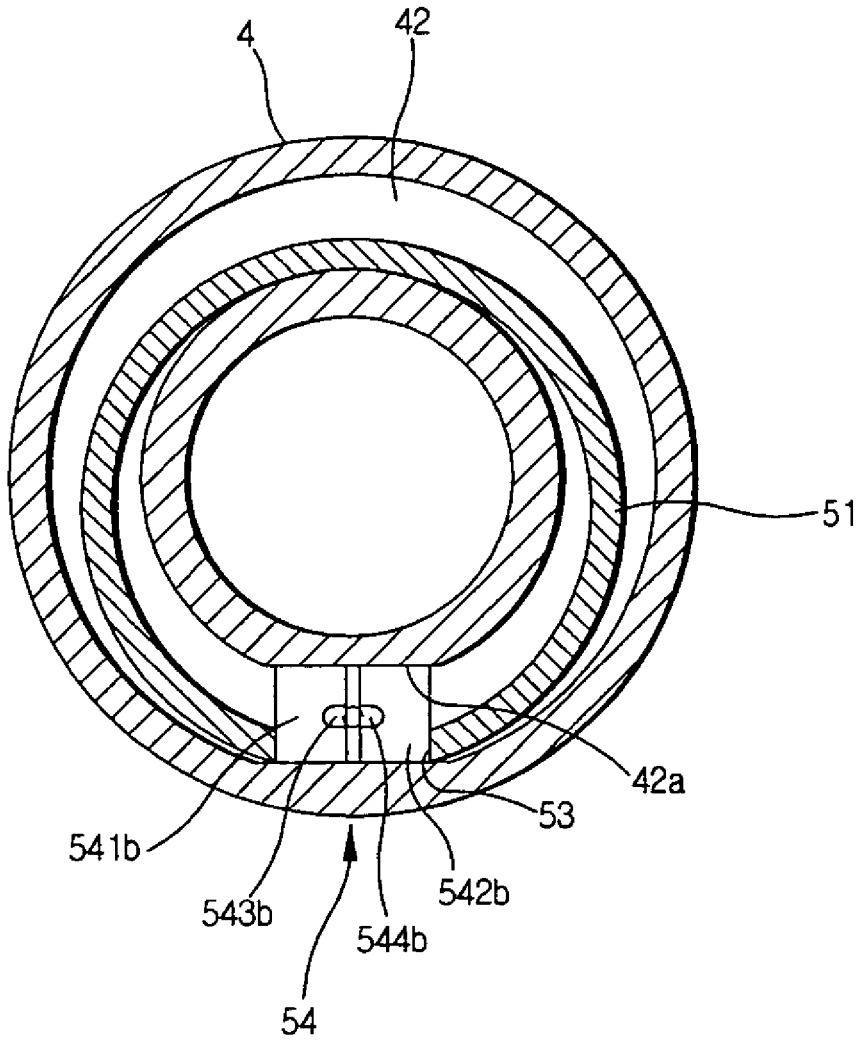
FIG. 9 is a plan view, in section, illustrating a slider adapting apparatus for orbiting vane compressors according to a third preferred embodiment of the present invention.
Figure 10:
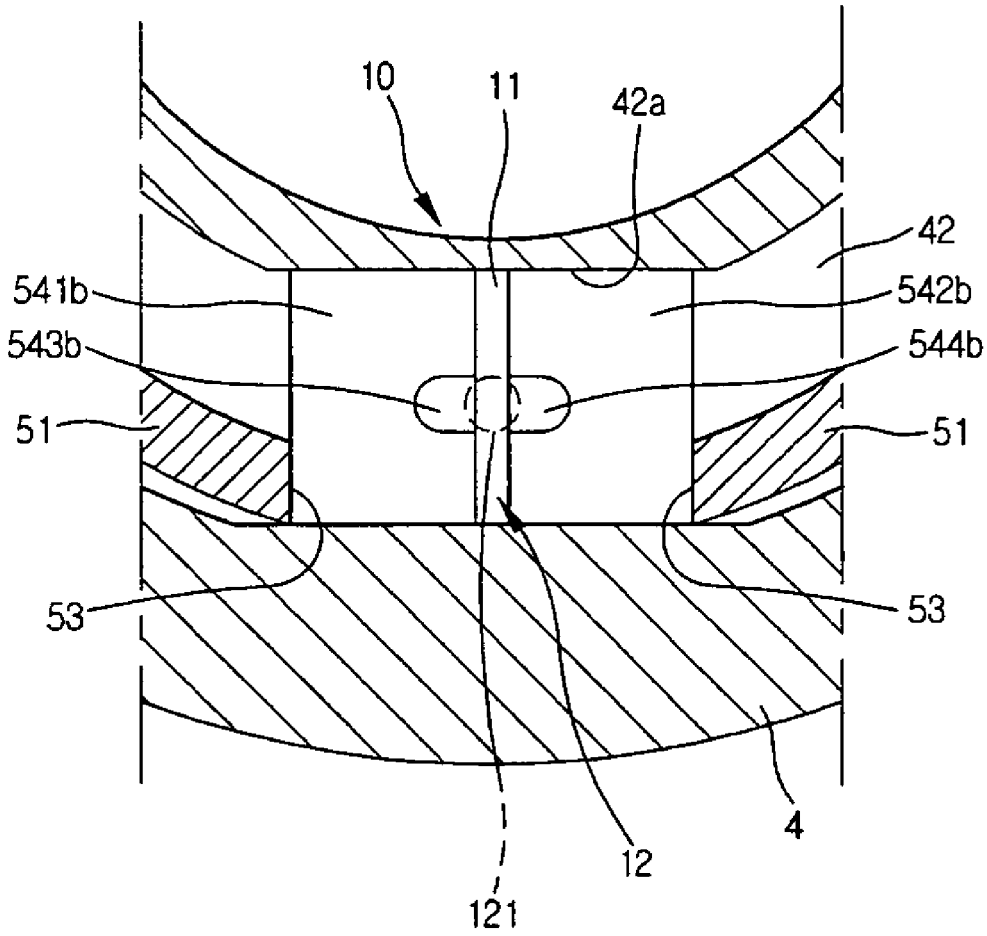
FIG. 10 is a partially enlarged view illustrating the slider adapting apparatus for orbiting vane compressors according to the third preferred embodiment of the present invention shown in FIG. 9.

FIG. 9 is a plan view, in section, illustrating a slider adapting apparatus for orbiting vane compressors according to a third preferred embodiment of the present invention, and FIG. 10 is a partially enlarged view illustrating the slider adapting apparatus for orbiting vane compressors according to the third preferred embodiment of the present invention shown in FIG. 9.

As shown in FIGS. 9 and 10, the slider adapting apparatus for orbiting vane compressors comprises: a sealing unit 54 disposed in tight contact with an opening 53 formed at a circular vane 51; and an adapting unit 10 for adapting the sealing unit 54 to the opening 53 of the circular vane 51.

The sealing unit 54 comprises: a first linear slider 541*b* disposed in tight contact with one end of the opening 53 of the circular vane 51; and a second linear slider 542*b* disposed in tight contact with the other end of the opening 53 of the circular vane 51.

The first linear slider 541*b* and the second linear slider 542*b* are formed in the shape of a linear block such that the first linear slider 541*b* and the second linear slider 542*b* are coupled with the circular vane 51, which is disposed in an annular space 42 defined in a cylinder 4, to perform linear reciprocating movement along a linear space section 42*a* formed in the annular space 42 while being in tight contact with both ends of the opening 53 of the circular vane 51.

The adapting unit 10 is configured to move the first linear slider 541*b* and the second linear slider 542*b* toward both ends of the opening 53 of the circular vane 51 or to withdraw the first linear slider 541*b* and the second linear slider 542*b* from both ends of the opening 53 of the circular vane 51 such that the first linear slider 541*b* and the second linear slider 542*b* are adapted to the orbiting movement of the circular vane 51.

Consequently, the adapting unit 10 moves the first linear slider 541*b* and the second linear slider 542*b* toward both ends of the opening 53 of the circular vane 51, until the first linear slider 541*b* and the second linear slider 542*b* come into tight contact with both ends of the opening 53 of the circular vane 51, respectively, to increase a sealing force between inner and outer compression chambers. Also, the adapting unit 10 withdraws the first linear slider 541*b* and the second linear slider 542*b* from both ends of the opening 53 of the circular vane 51, when severe interference occurs between the first and second linear sliders 541*b* and 542*b* and the opening 53 of the circular vane 51, to accomplish shock-absorption.

Specifically, the adapting unit 10 comprises: a gap 11 defined between the first linear slider 541*b* and the second linear slider 542*b*, which are spaced apart from each other; and a gap maintaining part 12 for maintaining the gap 11 while increasing and decreasing the gap 11.

The first linear slider 541*b* and the second linear slider 542*b* are spaced apart from each other by the gap 11, and then the gap 11 is increased by the gap maintaining part 12 until the first linear slider 541*b* and the second linear slider 542*b* come into tight contact with both ends of the opening 53 of the circular vane 51, respectively. When severe interference between the first and second linear sliders 541*b* and 542*b* and the opening 53 of the circular vane 51 occurs, the first linear slider 541*b* and the second linear slider 542*b* are withdrawn from both ends of the opening 53 of the circular vane 51 such that the gap 11 is decreased. In this way, occurrence of severe interference between the first and second linear sliders 541*b* and 542*b* and the opening 53 of the circular vane 51 is effectively prevented.

Preferably, the gap maintaining part 12 is composed of a gas guide hole 121 formed through the cylinder 4 above the gap 11. High-pressure refrigerant gas discharged out of the cylinder 4 is introduced into the gap 11 through the gas guide hole 121.

When the high-pressure refrigerant gas is introduced into the gap 11 defined between the first linear slider 541*b* and the second linear slider 542*b* through the gas guide hole 121, the first linear slider 541*b* and the second linear slider 542*b* are moved outward such that the gap 11 defined between the first linear slider 541*b* and the second linear slider 542*b* is increased. As a result, the first linear slider 541*b* and the second linear slider 542*b* come into tight contact with both ends of the opening 53 of the circular vane 51, respectively, and therefore, a sealing force between the inner and outer compression chambers is increased.

When severe interference occurs between the opening 53 of the circular vane 51 and the first and second linear sliders 541*b* and 542*b*, the first linear slider 541*b* and the second linear slider 542*b* are moved inward such that the gap 11 defined between the first linear slider 541*b* and the second linear slider 542*b* is decreased. As a result, shock-absorption is accomplished.

As described above, the first linear slider 541*b* and the second linear slider 542*b* are in tight contact with both ends of the opening 53 of the circular vane 51, under the condition that the first linear slider 541*b* and the second linear slider 542*b* can be withdrawn from both ends of the opening 53 of the circular vane 51, by means of the gap 11 and the gap maintaining part 12, such that the first linear slider 541*b* and the second linear slider 542*b* are adapted to the orbiting movement of the circular vane 51. Consequently, the tight sealing is accomplished between the inner and outer compression chambers formed in the annular space 42 of the cylinder 4, and at the same time, occurrence of severe interference between the opening 53 of the circular vane 51 and the first and second linear sliders 541*b* and 542*b* is effectively prevented.

The first linear slider 541*b* is provided at the upper surface thereof, which corresponds to the gas guide hole 121, with a first linear guide groove 543*b*, which is formed along the linear path of the first linear slider 541*b*. Similarly, the second linear slider 542*b* is provided at the upper surface thereof, which corresponds to the gas guide hole 121, with a second linear guide groove 544*b*, which is formed along the linear path of the second linear slider 542*b*.

The first linear guide groove 543*b* and the second linear guide groove 544*b* serve to smoothly guide high-pressure refrigerant gas discharged through the gas guide hole 121 into the gap 11 when the first linear slider 541*b* and the second linear slider 542*b* perform the linear reciprocating movement along the linear space section 42*a* of the cylinder 4 together with the circular vane 51.

Consequently, the first linear guide groove 543*b* and the second linear guide groove 544*b* are formed in the shape of a straight line such that the first linear guide groove 543*b* and the second linear guide groove 544*b* correspond to the gas guide hole 121 while following the movement paths of the first linear slider 541*b* and the second linear slider 542*b*, i.e., the linear paths of the first linear slider 541*b* and the second linear slider 542*b* in which the first linear slider 541*b* and the second linear slider 542*b* are moved along the linear space section 42*a* of the cylinder 4.

Figure 11:
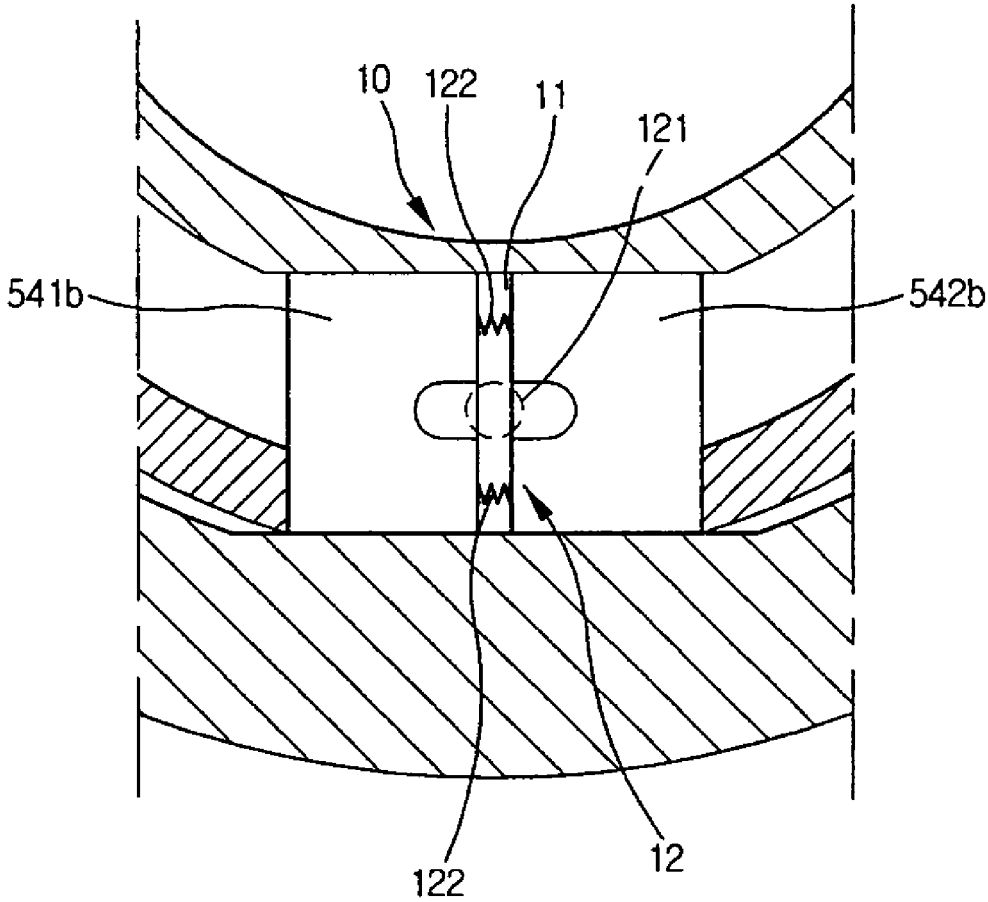
FIG. 11 is a partially enlarged plan view, in section, illustrating a slider adapting apparatus for orbiting vane compressors according to a fourth preferred embodiment of the present invention.

FIG. 11 is a partially enlarged plan view, in section, illustrating a slider adapting apparatus for orbiting vane compressors according to a fourth preferred embodiment of the present invention.

As shown in FIG. 11, the adapting unit 10 of the slider adapting apparatus comprises: a gap 11 defined between a first linear slider 541*b* and a second linear slider 542*b*, which are spaced apart from each other; and a gap maintaining part 12 for maintaining the gap 11 while increasing and decreasing the gap 11.

The gap maintaining part 12 is composed of a resilient member 122 disposed in the gap 11 while being in tight contact with the inside surface of the first linear slider 541*b* and the inside surface of the second linear slider 542*b*.

The resilient member 122 serves to push the first linear slider 541*b* and the second linear slider 542*b* outward, such that the gap 11 between the first linear slider 541*b* and the second linear slider 542*b* is increased, by its own resilient force. Consequently, the operation of the first linear slider 541*b* and the second linear slider 542*b* is smoothly performed by virtue of the resilient member 122, when the operation of the orbiting vane compressor is initiated, i.e., when high-pressure refrigerant gas is not introduced into the gap 11 through the gas guide hole 121.

Preferably, the resilient member 122 is a coil spring, having one end connected to the inside surface of the first linear slider 541*b* and the other end connected to the inside surface of the second linear slider 542*b*, for applying a resilient force to the first linear slider 541*b* and the second linear slider 542*b*. It is understood, however, that the resilient member 122 may take any other various shapes instead of the coil spring.

Moreover, it is possible to use only the resilient member 122, which is disposed in the gap 11 while being in tight contact with the inside surface of the first linear slider 541*b* and the inside surface of the second linear slider 542*b*, without the introduction of high-pressure refrigerant gas into the gap 11. It can be easily understood, in this case, that the slider adapting apparatus for orbiting vane compressors is still adequately operated.

As apparent from the above description, the slider adapting apparatus for orbiting vane compressors according to the present invention is capable of adapting the sliders to the circular vane to increase shock-absorption and the sealing force while preventing interference from occurring between the opening formed at the circular vane and outside surfaces of the sliders. Consequently, the present invention has the effect of preventing damage to parts and a locking phenomenon due to severe interference between the circular vane and the sliders, and therefore, effectively preventing the drive unit from suffering overload and catching fire.

According to the present invention, the sliders, which are provided in a pair, are spaced apart from each other by high-pressure refrigerant gas such that the sliders can be more smoothly adapted to the circular vane. Consequently, the present invention has the effect of accomplishing easy manufacture and installation of the slider adapting apparatus for orbiting vane compressors. Also, the shock-absorption of the sliders is more stably improved, and the sealing force of the sliders is considerably increased.

According to the present invention, the resilient member is disposed between the sliders such that the sliders can be adapted to the circular vane in a more simple structure, and the sliders can be properly operated before high-pressure refrigerant gas is created when the operation of the orbiting vane compressor is initiated. Consequently, the present invention has the effect of accomplishing easy manufacture and installation of the slider adapting apparatus for orbiting vane compressors. Also, the operation of the orbiting vane compressor is more stably performed.

According to the present invention, high-pressure gas is smoothly introduced into the gap defined between the sliders while the sliders are reciprocated. Consequently, the present invention has the effect of accomplishing more smooth adaptation of the sliders to the circular vane.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A slider adapting apparatus for an orbiting vane compressor, comprising:

an annular space defined between an inner wall of a cylinder and an inner ring; and an orbiting vane, wherein the orbiting vane comprises:

a circular vane disposed in the annular space;

a through-hole formed in the circular vane through which refrigerant gas is introduced into the circular vane;

an opening formed in the circular vane adjacent to the through-hole; and a pair of sliders disposed in the opening such that the sliders can be slid along the annular space, wherein the pair of sliders comprises:

a first curved slider which moves in a curve in the annular space, a first guide groove being formed in an upper surface of the first curved slider;

a second curved slider which moves in a curve in the annular space, a second guide groove being formed in an upper surface of the second curved slider;

a gap defined between the first curved slider and the second curved slider, the first curved slider and the second curved slider being spaced apart from each other; and a gap maintaining part which controls a size of the gap, the gap maintaining part comprising a gas guide hole formed in the cylinder above the gap through which high-pressure refrigerant gas is introduced into the gap.

2. The apparatus as set forth in claim 1, wherein the first curved slider and the second curved slider are formed in the shape of an arc-shaped block to allow the first curved slider and the second curved slider to perform a curved reciprocating movement along the annular space while being in tight contact with ends of the opening of the circular vane.

3. The apparatus as set forth in claim 1, wherein the gap maintaining part comprises:

a resilient member disposed in the gap while being in tight contact with an inside surface of the first curved slider and an inside surface of the second curved slider.

4. A linear slider adapting apparatus for an orbiting vane compressor, comprising:

an annular space defined between an inner wall of a cylinder and an inner ring;

a linear space section formed in the annular space, the linear space section being defined by linear parts of the inner wall of the cylinder and the inner ring, which are parallel with each other; and an orbiting vane, wherein the orbiting vane comprises:

a circular vane disposed in the annular space;

a through-hole formed in the circular vane through which refrigerant gas is introduced into the circular vane;

an opening formed in the circular vane adjacent to the through-hole;

first and second linear sliders disposed in the opening such that the first and second linear sliders can slide along the linear space section, a first linear guide groove being provided in an upper surface of the first linear slider and a second linear guide groove being provided in an upper surface of the second linear slider;

a gap defined between the first linear slider and the second linear slider, the first linear slider and the second linear slider being spaced apart from each other; and a gap maintaining part which controls a size of the gap, the gap maintaining part comprising a gas guide hole formed in the cylinder above the gap through which high-pressure refrigerant gas is introduced into the gap.

5. The apparatus as set forth in claim 4, wherein the first linear slider and the second linear slider are formed in the shape of a linear block such that the first linear slider and the second linear slider perform a linear reciprocating movement along the linear space section.

6. The apparatus as set forth in claim 4, wherein the gap maintaining part comprises:

a resilient member disposed in the gap while being in tight contact with an inside surface of the first linear slider and an inside surface of the second linear slider.

* * * * *